US008963730B1

(12) United States Patent
Dickerman

(10) Patent No.: US 8,963,730 B1
(45) Date of Patent: Feb. 24, 2015

(54) MAINTENANCE WARNING INHIBITOR BASED ON TIME OF DAY

(71) Applicant: BRK Brands, Inc., Aurora, IL (US)

(72) Inventor: Robert Leon Dickerman, Northfield, MA (US)

(73) Assignee: BRK Brands, Inc., Boca Raton, FL (US)

( * ) Notice: Subject to any disclaimer, the term of this patent is extended or adjusted under 35 U.S.C. 154(b) by 25 days.

(21) Appl. No.: 13/854,728

(22) Filed: Apr. 1, 2013

(51) Int. Cl.
*G08B 21/00* (2006.01)
*G04G 19/12* (2006.01)

(52) U.S. Cl.
USPC ..... 340/636.1

(58) Field of Classification Search
CPC ..... G08B 21/00; G04G 19/00; G04G 19/12
USPC ..... 340/309.16, 309.3, 309.7, 309.8, 309.9, 340/636.1, 636.15, 636.19, 7.37, 7.39, 7.58, 340/7.62, 309.4; 368/10, 13, 47, 251; 455/566, 567, 569.1, 575.1
See application file for complete search history.

(56) References Cited

U.S. PATENT DOCUMENTS

| | | | | |
|---|---|---|---|---|
| 4,287,517 | A | 9/1981 | Nagel | |
| 4,313,110 | A | 1/1982 | Subulak et al. | |
| 4,349,748 | A | 9/1982 | Goldstein et al. | |
| 5,686,896 | A | 11/1997 | Bergman | |
| 5,815,066 | A | 9/1998 | Pumilia | |
| 5,828,312 | A * | 10/1998 | Yamazaki | 340/7.58 |
| 5,936,532 | A | 8/1999 | Peralta | |
| 6,081,197 | A | 6/2000 | Garrick et al. | |
| 6,307,482 | B1 | 10/2001 | Le Bel | |
| 6,453,169 | B1 * | 9/2002 | Maloney | 455/575.1 |
| 6,624,750 | B1 | 9/2003 | Marman et al. | |
| 6,642,849 | B1 | 11/2003 | Kondziolka | |
| 6,717,520 | B1 * | 4/2004 | Dorenbosch | 340/636.1 |
| 6,753,786 | B1 | 6/2004 | Apperson et al. | |
| 6,762,688 | B2 | 7/2004 | Johnston et al. | |
| 7,508,314 | B2 | 3/2009 | Andres et al. | |
| 7,746,242 | B2 | 6/2010 | Schwendinger et al. | |

(Continued)

FOREIGN PATENT DOCUMENTS

EP 2051221 B1 1/2011

OTHER PUBLICATIONS

Smith, C.L., Smoke Detector Operability Survey—Report on findings, Nov. 1993, Revised, Oct. 1994, U.S Consumer Product Safety Commission, Bethesda, MD.

Ahrens, Marty, Smoke Alarms in U.S. Home Fires, 2011, National Fire Protection Association (NFPA), Quincy, MA.

(Continued)

*Primary Examiner* — Van T. Trieu
(74) *Attorney, Agent, or Firm* — Lawrence J. Shurupoff

(57) ABSTRACT

In an apparatus that issues maintenance warnings, such as the low-battery audio warnings issued by smoke and carbon monoxide detectors, a system for insuring that warnings are issued only at times of day when it is likely that residents will be awake, so as not to interrupt sleep. In the simplest embodiments, the system may comprise an oscillator, a 24-hour timer, and control logic, most of which may be contained in a microcontroller. One embodiment allows manual selection of the time of day of inhibiting warnings by pressing a pushbutton once. In other embodiments the starting time for the issuing a warning is close to the time of day at which the battery was installed, or the time of day that the detector was last tested. The latter embodiments are automatic, and require no user configuration.

6 Claims, 5 Drawing Sheets

(56) References Cited

U.S. PATENT DOCUMENTS

2006/0232139 A1 10/2006 Mullin
2013/0178248 A1* 7/2013 Kim ..... 455/566

OTHER PUBLICATIONS

Underwriters Laboratories Safety Standard UL 217—Standard for Single and Multiple Station Smoke Alarms, 2007, Underwriters Laboratories, Northbrook, IL.

* cited by examiner

MAINTENANCE WARNING INHIBITOR BASED ON TIME OF DAY

BACKGROUND

The National Fire Protection Association (NFPA), in "Smoke Alarms in U.S. Home Fires" (2011), and the U.S. Consumer Product Safety Commission (CPSC), in "Smoke Detector Operability Survey Report" (1994) have reported that, although nearly all U.S. residences have smoke detectors installed at any given time, approximately 20% are not functioning. Moreover, most of these aren't functioning because residents have removed the batteries in order to silence nuisance alarms. Nuisance alarms include any false hazard alarm which is not triggered by an actual hazard, such as those smoke alarms caused by smoke from non-hazardous cooking activities, or shower mist, for example. Nuisance alarms also include any routine maintenance warning that inconveniences a resident, such as a low-battery warning that is sounded while a resident is sleeping. Much prior work on this topic has focused on the prevention of false hazard alarms.

I believe that most nuisance alarms are actually low-battery warnings, and that most users disable hazard detectors because a low-battery warning has interrupted someone's sleep. This is certainly true at my residence, and I believe that it is likely true elsewhere, for the following two reasons.

First, although only some small fraction of properly installed hazard detectors will ever issue a false hazard alarm, every single installed hazard detector that uses a battery will eventually produce a low-battery warning if its battery is not replaced before it gets weak. Although there have been recent campaigns to encourage residents to change batteries on a regular schedule, it seems likely that only some small fraction of users actually do this fastidiously. To put this in perspective, even if we generously estimate that an unrealistically high percentage of users, say 70%, fastidiously changes batteries on a predetermined schedule, the remaining 30% of the installed detectors will eventually issue a low-battery warning. Since the installed base of battery-operated or battery-backed detectors in the US is on the order of 100 million units, with a typical battery life of one year, we may calculate that there will be about 30 million low-battery warnings sounded in the US each year. Any of these low-battery warnings that happen to awaken residents from their sleep is likely to result in the immediate and indefinite disabling of the detector.

Second, I believe that there is a pronounced and unfortunate tendency for these 30 million low-battery warnings to be sounded at night, when most, albeit not all, residents are asleep. The likely reason, quite apart from Murphy's Law, as Bergman pointed out in U.S. Pat. No. 5,686,896 (1997), is that residences tend to be cooler at night. Also since battery voltages drop at lower temperatures, the low-battery warning is consequently more likely to be sounded at night. Again, I believe that a typical resident will deal with these late-night low-battery warnings by un-mounting the detector and/or forcefully removing its batteries, throwing the detector somewhere to be handled later, at some more convenient time, and then going back to bed. Moreover, it is likely that many residents, after haven been awakened by hazard detectors one or more times, will have serious misgivings about ever returning the detectors to service.

The above two reasons also seem plausible after consideration of the responses given to survey questions in the previously mentioned consumer survey conducted by the CPSC.

Hence, there are a lot of low-battery warnings and they often cause an infuriating inconvenience. Even worse, they often constitute a significant threat to health, safety, and property, because they likely often lead to the immediate and indefinite disabling of the hazard detector.

In contrast, I believe that if a low-battery warning is noticed by a resident during normal waking hours, it is much more likely that he or she will calmly take a minute to resolve the issue immediately by replacing the battery and restoring the hazard detector to service.

Since this scenario unfolds perhaps 30 million times per year or more in the US alone, it seems prudent to shift the odds in favor of convenience and, consequently, to enhance consumer safety.

PRIOR ART

Prior-art devices for temporary silencing maintenance warnings has been less than satisfactory. The following is a list of some prior art that presently appears relevant:

| patent or Pub. Nr. | Kind Code | Issue or Pub. Date | Patentee or Applicant |
|---|---|---|---|
| U.S. 2006/0232139 | A1 | Oct. 19, 2006 | Mullin |
| U.S. 4,349,748 | B1 | Sep. 14, 1982 | Goldstein,et al. |
| U.S. 4,287,517 | B1 | Sep. 1, 1981 | Nagel |
| U.S. 4,313,110 | B1 | Jan. 26, 1982 | Subulak et al. |
| U.S. 5,686,896 | B1 | Nov. 11, 1997 | Bergman |
| U.S. 5,815,066 | B1 | Sep. 29,1998 | Pumilia |
| U.S. 5,936,532 | B1 | Aug. 10, 1999 | Peralta |
| U.S. 6,081,197 | B1 | Jun. 27, 2000 | Garrick et al. |
| U.S. 6,307,482 | B1 | Oct. 23, 2001 | Le Bel |
| U.S. 6,624,750 | B1 | Sep. 23, 2003 | Marman et al. |
| U.S. 6,642,849 | B1 | Nov. 4, 2003 | Kondziolka |
| U.S. 6,762,688 | B2 | Jul. 13, 2004 | Johnston et al. |
| U.S. 6,753,786 | B1 | Jun. 22, 2004 | Apperson et al. |
| U.S. 7,508,314 | B2 | Mar. 24, 2009 | Andres et al. |
| U.S. 7,746,242 | B2 | Jun. 29, 2010 | Schwendinger et al. |
| EP 2051221 | B1 | Jan. 19, 2011 | Addy et al. |

NON-PATENT LITERATURE

SMITH, C. L., Smoke Detector Operability Survey—Report on findings, November 1993, Revised, October 1994, U.S. Consumer Product Safety Commission, Bethesda, Md.

AHRENS, MARTY, Smoke Alarms in U.S. Home Fires, 2011, National Fire Protection Association (NFPA), Quincy, Mass.

Underwriters Laboratories Safety Standard UL 217—Standard for Single and Multiple Station Smoke Alarms, 2007, Underwriters Laboratories, Northbrook, Ill.

Johnston et al. and Kondziolka (above), and many commercially available smoke detectors, have a "HUSH" feature, i.e., a pushbutton on the detector that may be used to temporarily disable the low-battery warning after it begins. Similarly, a remote control may be provided that may be used to mute the low-battery warning. Neither of these is satisfactory because, in more than half of the cases, residents are first awakened by the low-battery warning, and must rise to manually disable it. In addition, they must remember, in their groggy state, to press the pushbutton, rather than removing the batteries. Even if they respond correctly, there is no guarantee that they will not be soon awakened again for the same warning.

Another existing approach, disclosed in Nagel (above), is to incorporate a photosensor to detect ambient light, and only sound the maintenance warning when sufficient ambient light is detected. This approach has several disadvantages. First, it presumes that residents sleep at night, but this is not always true; some people sleep during the day. Second, even if the residents do happen to sleep at night, some smoke detectors are installed in locations that are often dark or shadowed, such as cellars, or in locations that are illuminated by artificial light, making a suitable choice of light threshold difficult or impossible. Third, this approach entails the extra cost of providing and calibrating a photosensor, an interface to the photosensor, and a comparator mechanism for deciding whether the sensed light exceeds a suitable threshold.

Another approach, disclosed in Addy et al. (above), makes use of the effect of lower night temperatures noticed by Bergman, supra. Addy proposed that the day and night cycle of residence temperature be monitored by tracking the corresponding day and night fluctuation of battery voltage, and that the low-battery warning be sounded only during the interval corresponding to daytime. As with the previous method, this presumes that residents sleep at night, but this is not always true, since some people sleep during the day; further, the temperature of many residences is maintained at a steady value by automatic control systems, and so may not fluctuate in any meaningful way. Therefore, this method is not desirable.

Another approach, disclosed in Andres et al. (above), is to apply a random time delay between the sounding of routine maintenance warnings. This is done with the hope that, perhaps residents' sleep will not be too disturbed by the random warnings, and that some warnings will occur during waking hours when the maintenance may be performed. This method is not satisfactory because residents are again, in many cases, awakened by the maintenance warning.

Yet another approach that has been employed, as seen in, for example, Bergman (above), is to first issue a so-called passive report, such as a small flashing lamp, so as not to wake residents, and later, if the maintenance condition is not addressed, to issue a so-called active report, such as the usual loud audio low-battery warning chirp. This method is not satisfactory because residents are unlikely to ever notice the passive report.

A related approach is proposed by Schwendinger et al. They propose a sequence of progressively more intrusive low-battery warnings. This method is unsatisfactory because the warning that is intrusive enough to first be perceived by the resident may be delivered while the resident is sleeping.

SUMMARY

To alleviate the problem of low-battery alarms in smoke detectors and the like sounding at inauspicious or inopportune times, I provide a mechanism for muting routine maintenance audio warnings. An advantageous aspect is that it causes routine maintenance audio warnings, such as low-battery warnings and sensor end-of-life warnings, to be sounded at a time when it is likely that residents will be awake, rather than sleeping. On one embodiment it comprises a continuously running oscillator that drives a 24-hour timer, control and interface logic, and reset circuitry, together with a battery-condition sensor. The timer maintains the time of day. The battery condition sensor detects whether the battery has become partially discharged. The control and interface logic selects the time when the subsequent low-battery warning is to be muted, and mutes the warning accordingly, at least in the initial days that the warning is sounded.

The muting interval that is used may be selected in a number of different ways. In some embodiments, the start of the muting interval is referenced to the time of day that the battery was installed, or the time of day at which a TEST/HUSH or TEST/SILENCE pushbutton switch was last pressed. These embodiments may be completely automatic and require no user configuration whatsoever. In other embodiments, the time-of-day for muting is manually selected by the user. In one manual method, the user simply presses a pushbutton once at the time of day when muting to begin. In other embodiments, the muting interval is selected by setting times in a familiar user interface.

The basic functions of the mechanism may be implemented in an inexpensive microcontroller, or, alternately, dedicated hardware may be used. Some of the embodiments may be incorporated into certain existing hazard detectors by simply modifying existing microcontroller software, thereby incurring little or no added production hardware cost.

DRAWINGS

REFERENCE NUMERALS

Figure 1:
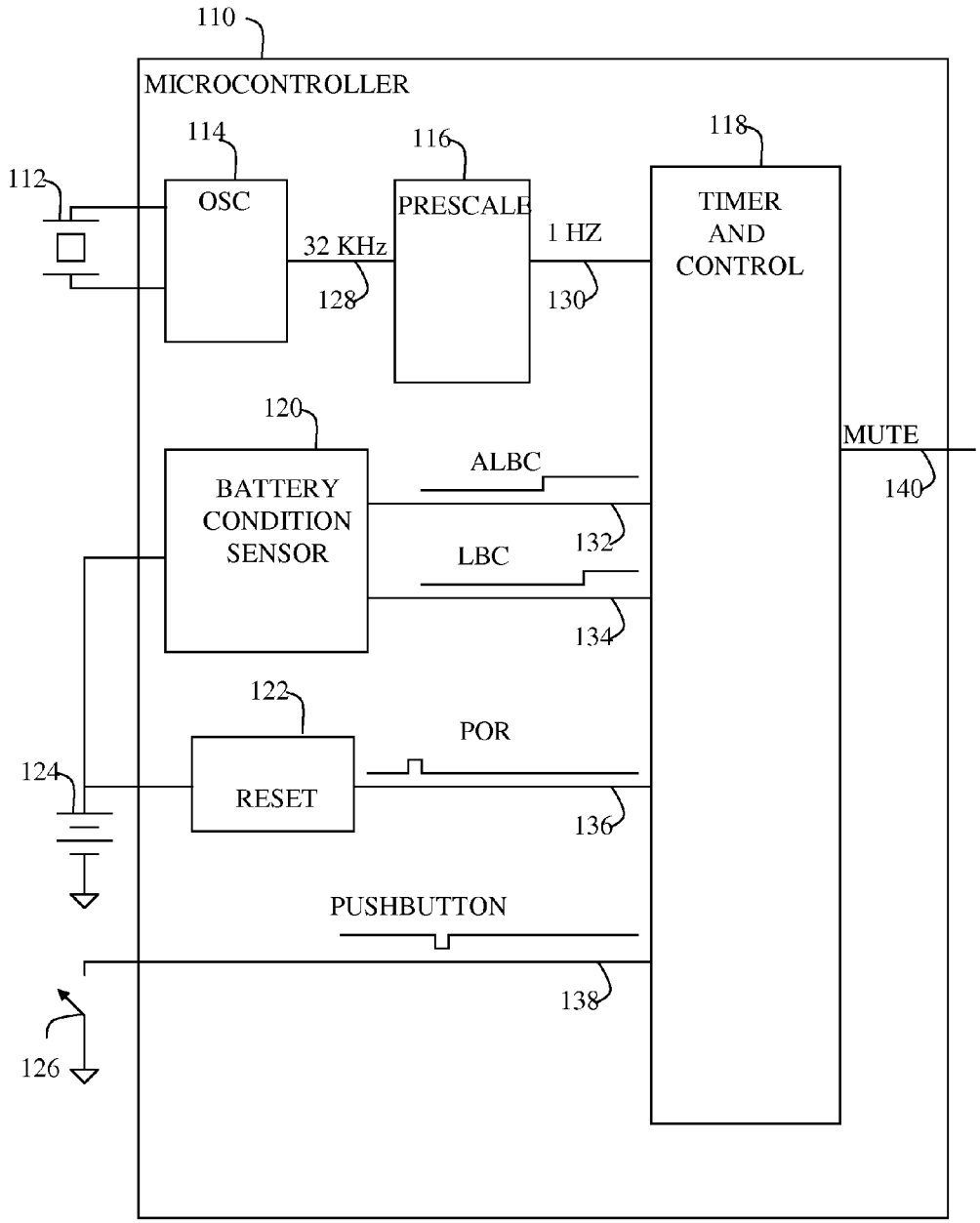
FIG. 1 is a block diagram of a basic mechanism for muting routine maintenance audio warnings.

110 microcontroller, or dedicated digital and analog hardware
112 crystal
114 oscillator
116 prescaler
118 timer and control logic or software
120 battery condition sensor
122 reset circuitry
124 battery
126 pushbutton switch
128 oscillator output signal, e.g. 32.768 KHz waveform
130 prescaler output signal, e.g. 1.0 Hz waveform
132 ALBC Almost-Low-Battery Condition signal
134 LBC Low-Battery-Condition signal
136 POR Power-On Reset signal
138 PUSHBUTTON signal
140 MUTE signal
210 POR Power-On Reset start symbol
212 INITialize VARiableS process block
214 SLEEP process block
216 Test PUSHBUTTON conditional block
218 Test DAYS conditional block
220 MUTE=0 process block
222 Test UPDATE_TIMER conditional block
224 24 HOUR TIMER subroutine block
228 Test ALBC conditional block
230 DAY COUNTER subroutine block
234 Test TIME OF DAY conditional block
236 MUTE=1 process block
238 MUTE=0 process block
310 INTERRUPT entry symbol

312 Test INTerrupt_FLAG conditional block
314 RESET INTerrupt_FLAG process block
316 PROCESS OTHER INTERRUPTS process block
318 RETURN exit symbol
432 LOOK UP TABLE subroutine block
512 CLOCK pushbutton switch
514 display
516 display signals
514A display layout, example A
514B display layout, example B

DETAILED DESCRIPTION

General Functions

At the time of this writing, smoke detectors and carbon monoxide detectors sold in the US must comply with the requirements of Underwriters Laboratory Safety Standard 217 (UL 217). One of the requirements of this standard is that, before the battery dies completely, the hazard detector must be capable of reliably discerning that the battery is near death, a condition called low-battery condition (LBC). Upon detecting LBC, the hazard detector must sound a low-battery warning chirp once per minute for a minimum of seven consecutive days. Therefore, if warnings are initially muted for a portion of each day, as in the present system, the days during which muting occurs must still be followed by at least 7 days of around-the-clock warnings.

This requirement may be accommodated by defining and detecting a second battery condition, called almost-low-battery condition (ALBC), which may represent a slightly lower internal resistance and slightly higher open-circuit voltage, as compared to the UL-required LBC. Therefore, the ALBC will normally occur before the LBC. When ALBC is detected, the mechanism may start sounding a low-battery warning, but may mute the warning for a portion of each day in order to notify residents, during waking hours, of the impending demise of the battery. When the battery is subsequently further drained, and LBC is detected, the mechanism may end all muting, and sound the more intrusive around-the-clock low-battery warning for at least seven days in order to comply with UL 217.

In one embodiment ALBC is detected using a battery condition sensor comprising a comparator and voltage reference. Alternatively ALBC can be detected by using an analog-to-digital converter together with a hardware or software comparator and a reference code, or any other conventional circuitry that measures the battery voltage and compares it to a reference value. An ALBC detector may actually use the same hardware as is used for detecting LBC, if the condition sensor is implemented with an analog-to-digital converter. The output logic signals or software variables from the battery condition detector representing the status of ALBC and LBC may be latched, meaning that once either condition occurs, the logic signal or software variable representing it will remain set for the remainder of the battery life. If this is the case, the sequence of events that ensues will be more determinate, i.e., ALBC and its attendant partially-muted warnings will occur first, and continue until LBC is detected, whereupon the around-the-clock, once-per-minute, low-battery warning will begin, and continue, until the battery is dead.

A second way to satisfy the UL 217 requirement is to define only a single battery condition, ALBC, at a high enough voltage so that there is very likely to be enough battery energy left when ALBC is detected to first sound the partially-muted warnings that are the topic of this patent, and to thereafter sound the mandatory warning; LBC is not used in this second way. The ALBC signal may be latched, as described. The partially-muted warnings will begin when ALBC is first detected, and continue for a predetermined number of days, whereupon the mandatory around-the-clock, once-per-minute, low-battery warning will be issued for at least seven days. This warning will continue until the battery is dead or is replaced. An advantage of this second way is that the battery condition sensor may be simpler, since only one battery condition needs to be defined and tested.

Figure 2:
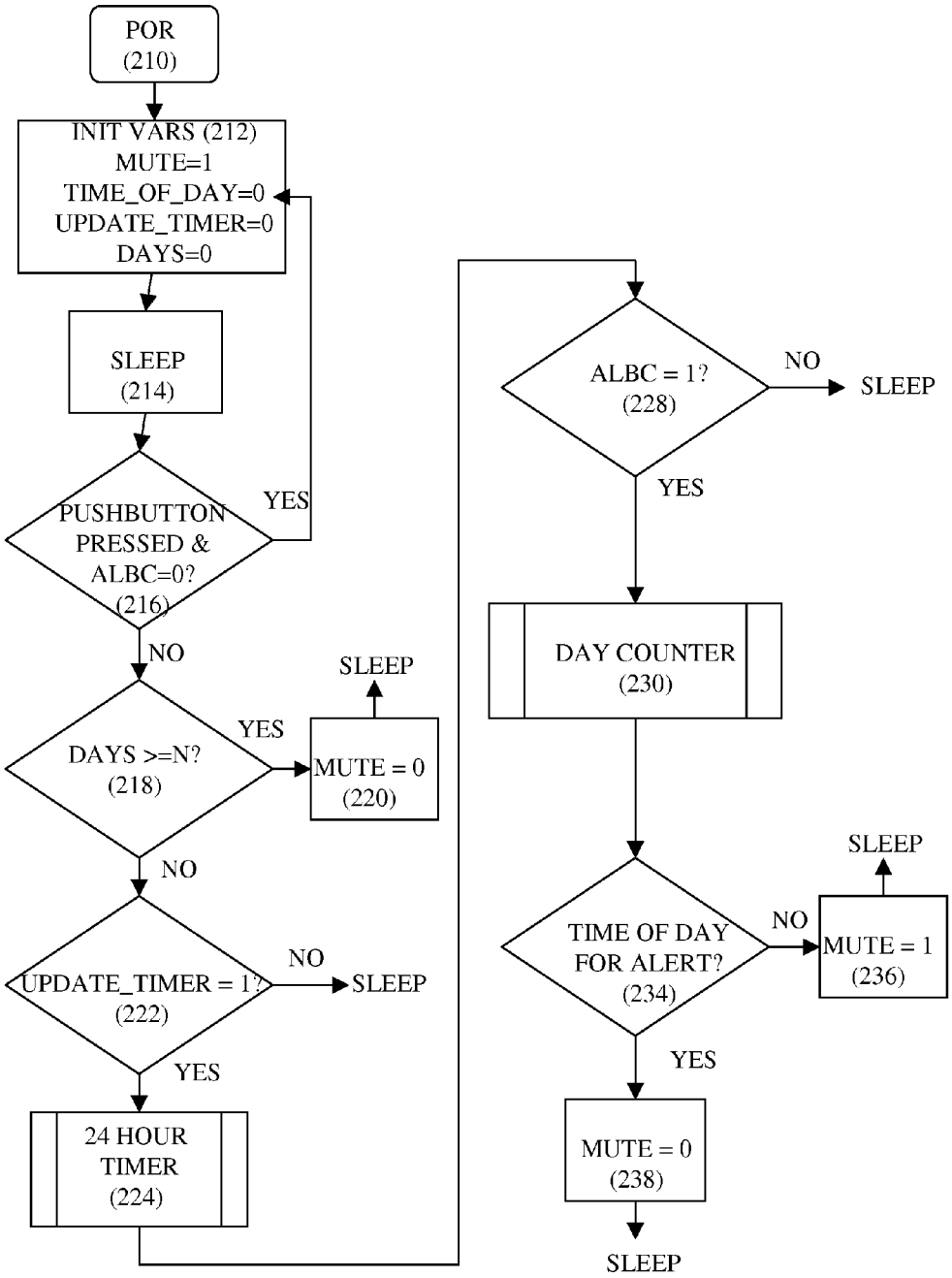
FIG. 2 is a flow chart that illustrates an example of the operation of certain embodiments.
Figure 4:
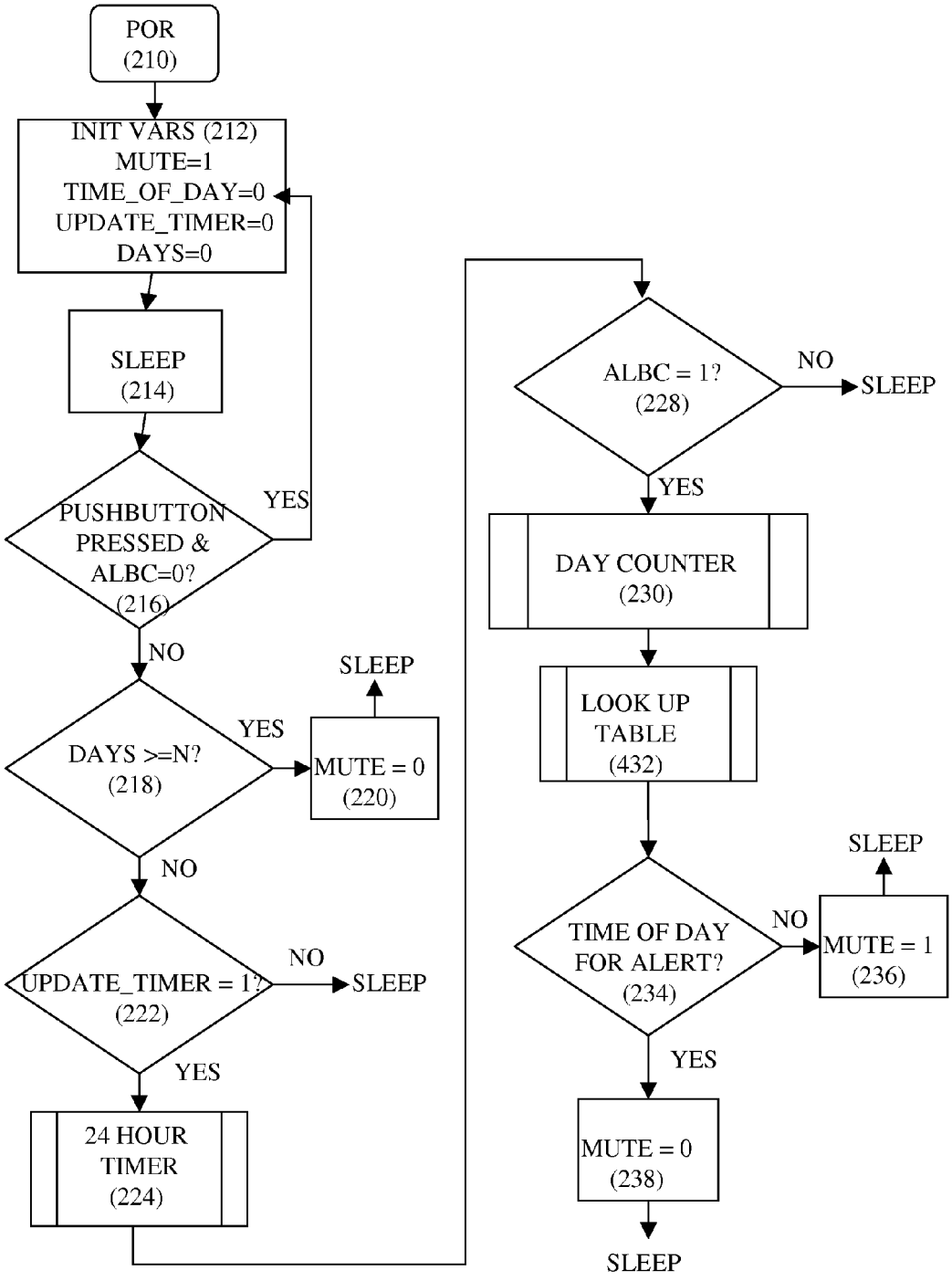
FIG. 4 is a flow chart that illustrates an example of the operation of certain embodiments, that includes a look-up table.

Either way may be used with equivalent results, and, for completeness, both ALBC and LBC signals are shown in the block diagram of FIG. 1; however, in the interest of brevity, only the second way, i.e., the single-battery-condition example, is illustrated in the flow charts of FIGS. 2 and 4 and described in detail. Any skilled practitioner will be able to implement the first way, i.e., the double-battery-condition example, in a like manner.

First Embodiment

Warning at Time of Day Detector was Last Handled

In a first embodiment, the control and interface logic automatically mutes the routine maintenance audio warning at all times except those proximate to the time of day at which the timer was last reset, referred to here as the reference time of day. For example, when ALBC is first detected, the first embodiment may be designed to initially mute the routine maintenance audio warning at all times except those starting one hour before, and ending one hour after, the reference time of day.

In this embodiment, the reference time of day corresponds to the time of day at which the detector was last handled. Specifically, the reference time of day may be set to the time of day that the battery was installed, or the time of day that a switch on the hazard detector was manually activated.

The timer may be reset when the battery is installed, thereby establishing this as the reference time of day. Since the battery will usually be installed at a time of day when the user is normally awake, if, for instance, the hazard detector's audio warning starts one hour before the reference time of day, and ends one hour after the reference time of day, the warning will sound only when the user is likely to be awake.

The timer may be additionally reset by a press of a pushbutton switch, including, for example, the ubiquitous TEST/HUSH or TEST/SILENCE switch that is typically used to test or temporarily silence a smoke alarm, or, alternately, a dedicated switch. This reset function may be accomplished by connecting the switch contacts to the logic or microcontroller, or by any other conventional method. The warning sounding interval may then be proximate to the time of day that the pushbutton was last pressed, if it is pressed; otherwise, the sounding interval may be proximate to the time of day that the battery was installed, as before. The warning will be muted at all other times.

FIG. 1 shows a block diagram of a basic circuit for muting routine maintenance audio warnings. The circuit comprises a microcontroller (μc) 110 and a crystal 112. The μc contains an oscillator 114 that, together with crystal 112, produces a 32.768 KHz signal and a digital prescaler or divider 116 that divides this signal's frequency to produce a 1.0 Hz signal. Microcontroller 110 contains a battery condition sensor 120 that measures the battery voltage, a reset circuit 122 that produces a RESET signal 136 that resets the μc, allowing variables and circuits to be reset and preset at power on, and a software 24-hour timer.

Microcontroller 110 further contains a timer and control logic circuit 118, or equivalently, μc hardware and software 118, or any combination thereof that maintains time of day, and compares current time of day to starting and ending muting times. These times may be hard-coded, for example, so that the muting interval will be predefined. The μc finally produces a mute signal 140 that may be used to gate (turn on and off) the low-battery warning. Mute signal 140 may be conveyed outside the μc by an Input Output (IO) line, or it may exist only as an internal software variable or flag used to gate or affect other internal signals or variables that ultimately determine when the audio warning sounds.

Battery condition sensor 120 may be used to produce two low-battery signals: ALBC signal 132 and LBC signal 134. As mentioned, sensor 120 may comprise voltage references and comparators, or an on-chip analog-to-digital converter, or any other conventional means of detecting voltage. It may optionally load the battery with a current load while measuring the battery's voltage. In the present embodiments, ALBC and LBC signals 132 and 134 are assumed to be latched (held at their active value) after going active, either in hardware or in software, and are reset only when the battery is removed for replacement.

The circuit also includes an optional PUSHBUTTON switch 126 which, for the first embodiment, may, as mentioned above, be either an existing TEST/HUSH switch, or a dedicated switch.

FIG. 2 is a flow chart that illustrates an example of the operation of the circuit of FIG. 1 by the use of μc hardware and software. After power on reset (POR) occurs in block 210 the hardware modules and associated registers and the application software variables are initialized in a conventional manner (block 212). Then the processor may then sleep (block 214), until awakened by an interrupt.

Prescaler 116 (FIG. 1) may be configured to interrupt the microcontroller once for each time the prescaler reaches a terminal count. For instance, for count-up operation, the terminal count may be set to approximately $(2^{15}-1)=32,767$, so that, with a 32.768 KHz crystal oscillator, an interrupt is generated once per second. This interrupt may be used to cause the remainder of the flow chart of FIG. 2 to execute once per second to update time of day and other items.

Figure 3:
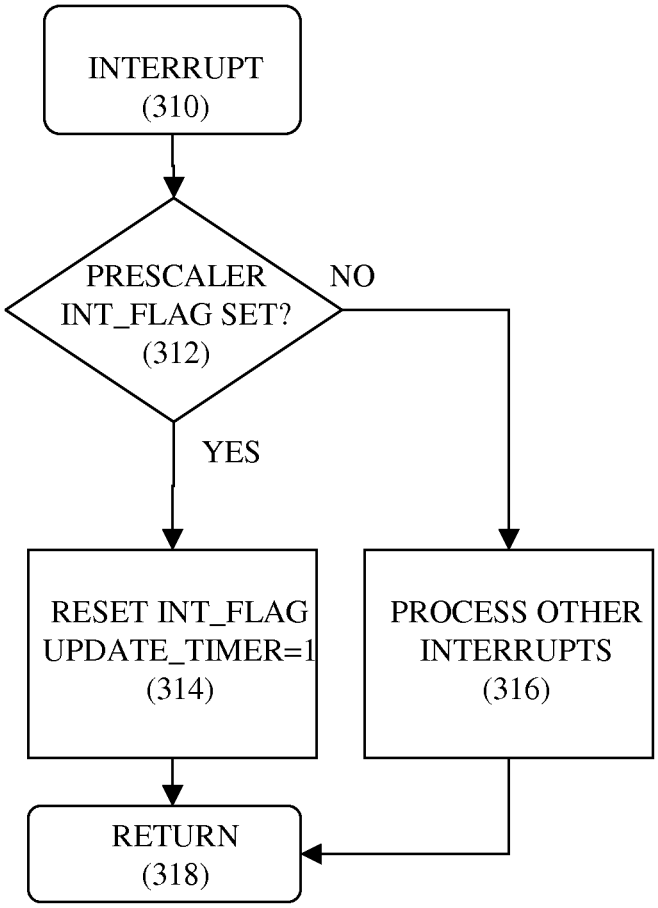
FIG. 3 is a flow chart that illustrates an example of the operation of a microcontroller interrupt routine that may be used with any of the embodiments.

FIG. 3 is a flow chart that illustrates an example of the operation of a μc interrupt routine that may be used with any of the embodiments, including the first embodiment. When an interrupt occurs, program control moves to block 310. Block 310 represents the entry point of the interrupt routine. If, when the interrupt flag associated with prescaler 116 is tested in block 312, it is found that the source of the interrupt was the prescaler, then the prescaler interrupt flag may be reset and a UPDATE_TIMER flag may be set in block 314. Otherwise, other interrupts may be processed. In either case, processor execution may return in block 318 to the main routine. Execution will resume at the block following SLEEP block 214 (FIG. 2).

Therefore, execution resumes at conditional block 216, where the state of switch 126 (FIG. 1) may be tested. Block 216 may actually test the switch signal itself, or may merely test a flag set by an interrupt or interrupt service routine triggered by the pressing of the switch. If the pushbutton is pressed at any time before the battery has been discharged time of day variables and the mute variable may be re-initialized to the extent that ALBC becomes active. For the simple example illustrated in the flow charts of FIGS. 2 and 3, the pushbutton may have to be pressed and held for more than 1 second; otherwise the pressing might not be detected.

In conditional block 218, the DAYS variable may be tested. In block 218, N is a predetermined number of days of partial muting, e.g., five. If, in block 218, it is found that DAYS is greater than or equal to N, this means that the predetermined number of days of partial muting has already passed, that it is no longer necessary to keep track of time of day, and that program execution needs never thereafter to proceed beyond block 216. Muting may be disabled and the processor may return to sleep in block 214. Thereafter, a low-battery warning may be sounded once per minute continuously until battery end of life or battery replacement.

If DAYS is not greater than or equal to N, then the UPDATE_TIMER flag is tested in block 222. If the UPDATE_TIMER flag is found to be set, then the UPDATE_TIMER flag is reset, and TIMER 224 is updated. In TIMER 224 a variable named TIME_OF_DAY may be defined to represent time of day in seconds, for example. TIMER 224 may usually be updated by simply incrementing TIME_OF_DAY by one second. However, if TIMER 224 has reached its terminal count of approximately 84,399, corresponding to approximately 24 hours, for example, it may be reset, by setting TIME_OF_DAY to 0.

If the UPDATE_TIMER flag is found to be reset, processor sleeps at block 214.

If TIMER 224 was updated, the ALBC signal is tested in conditional block 228. If ALBC is not set, the processor sleeps at block 214. Alternately, if ALBC is set, execution may move to DAY COUNTER 230. In DAY COUNTER 230, a DAYS count may be incremented once for each time that TIMER 224 rolls over to 0, for example.

In conditional block 234, the present time of day, as kept by TIMER 224, may be compared to predetermined time of day setpoints to determine whether the warning should be muted at any given time. These setpoints may be called STARTBEEP and STOPBEEP. STARTBEEP is defined as the time of day that the sounding of the warning starts; STOPBEEP is defined as the time of day that the sounding of the warning stops. For example, STARTBEEP may be set to 82,800 seconds, corresponding to 23 hours, and STOPBEEP may be set to 3,600 seconds, corresponding to one hour. In this example, STARTBEEP and STOPBEEP correspond to times of day that are one hour before and one hour after the reference time. If, as in the example given above, STARTBEEP>STOPBEEP, and STARTBEEP and STOPBEEP are equidistant from the reference time, the following rule or program steps may be used to determine the state of MUTE:

IF (TIME_OF_DAY>=STARTBEEP) OR (TIME_OF_DAY<STOPBEEP) THEN MUTE=0;
ELSE MUTE=1;

Compatible units of time must be used in these equations and all those to follow.

After MUTE has been accordingly set or reset in blocks 236 or 238, respectively, execution returns to sleep 214, until the next interrupt.

For the values of STARTBEEP and STOPBEEP given in the above example, the forgoing rule will cause muting to be disabled and the warning to be sounded when the TIME_OF_DAY variable is between approximately 23 hours and one hour. This corresponds approximately to the interval beginning 1 hour before the reference time, and ending 1 hour after the reference time. Other predetermined values than the example of two hours given above may be chosen for the warning-sounding interval, and the warning-sounding interval may be offset from the reference time of day by some pre-determined interval, if desired.

To summarize the operation of the first embodiment, a reference time of day will first be set to the time of day that a user installs a battery in the hazard detector, and thereafter may be set to the time of day that a TEST/HUSH switch is activated by the user. When a warning condition is subsequently detected, the warning will be initially be issued at times proximate to the reference time of day, and inhibited at other times of day. Thus, the warning will initially be issued at times of day proximate to the time of day at which the detector was installed, or last tested, or last hushed by the user, or the time of day when the battery was last replaced by the user. These times are likely to be during the user's normal waking hours.

An advantage of the first embodiment is that the muting interval is determined automatically by the mechanism itself. Consequently, it requires no new user knowledge or training whatsoever, and does not require the user to program or configure the mechanism in any way. Hence, it requires no conscious effort whatsoever to use.

Second Embodiment

Warning at Time of Day Detector was Last Handled, with Expanding Warning Interval A second embodiment may use the same hardware block diagram as the first embodiment (FIG. 1). However, a change is made in the operation of TIMER AND CONTROL block 118.

The logic or software in block 118 is designed such that, after the first day following the initial detection of ALBC, the un-muted period defined by the mechanism is gradually expanded.

For example, on the second day, the mechanism will allow the warning to sound during the period ranging from two hours before, and ending two hours after, the reference time of day, and on the third day, it will sound the warning during the period ranging from three hours before to three hours after the reference time of day, and so on. Thus, even if the warning sounding interval is started at a low value, and the audio warning is, at first, sounded at a time of day when residents are awake, but are absent from the residence, if the warning interval is gradually increased, the audio warning is likely to eventually be first heard by residents at a time when they are normally awake.

Consider the case in which the residents normally sleep at night, go to school and work during the day on weekdays, and spend weekends at home. If, for example, it happened that the detector's battery was installed at 9:00 PM, and ALBC was first detected at 3:00 AM on a Tuesday, the audio warning would first be sounded later that same day from 8:00 PM until 10:00 PM, and would likely be heard by residents during that interval. In a different example, if it happened that the detector's battery was installed at noon on a Saturday, and ALBC was first detected at 2:00 AM on a Monday, the audio warning would first be sounded near noon on that same Monday, and might not be heard. However, by Friday, the warning interval would have been expanded to 7:00 AM to 5:00 PM, and would likely be heard by one or more of the residents. In neither of these cases would residents be inconvenienced by the sounding of a warning while they were asleep. Hence, the embodiment begins by sounding a warning during a time interval when it is likely that residents will be awake, albeit not always present, and gradually expands the warning sounding time interval until that interval impinges upon a time when residents are both present and awake.

An example of the operation of the second embodiment may be described using the same interrupt routine flow chart as before (FIG. 3), but using a slightly different main routine flow chart, seen in FIG. 4. The only difference between the main routine flow chart of FIG. 2 for the first embodiment, and that of FIG. 4 for the second embodiment, is that LOOK UP TABLE subroutine block 432 is added in FIG. 4.

In FIG. 4, when execution reaches DAY COUNTER 230, the DAYS count is incremented once for each time that TIMER 224 rolls over to zero, as before. Then, the DAYS count is used as an input to LOOK UP TABLE 432 to select appropriate pairs of STARTBEEP and STOPBEEP values. The entries in LOOK UP TABLE 432 may be chosen to produce a sounding interval for the low-battery warning that grows larger as the days go by, or that varies in any arbitrary fashion. As an example, the following look up table may be used. Note that, although the values shown in the table are in units of hours, the values used in the actual implementation may be equivalent values in units of seconds, or some other convenient unit of time.

| DAYS (days) | STARTBEEP (hours) | STOPBEEP (hours) | Warning Sounding Interval (hours) |
|---|---|---|---|
| 0 | 23 | 1 | 2 |
| 1 | 22 | 2 | 4 |
| 2 | 21 | 3 | 6 |
| 3 | 20 | 4 | 8 |
| 4 | 19 | 5 | 10 |
| 5 | 18 | 6 | 12 |

Of course, any other desired progression of warning sounding interval can be used, including progressions that use fractions of hours.

An alternative means of expanding, or otherwise changing, the warning interval is to use mathematical functions, with DAYS as an input to the functions, to increase STARTBEEP and STOPBEEP as DAYS increase, for example, all in a conventional manner.

The state of MUTE may be determined in the same manner as for the first embodiment.

Therefore, in the second embodiment, the warning will initially be sounded at times proximate to the time of day at which the detector was last handled, but may be sounded over an increasing interval of time as days pass.

Note that this embodiment permits the sounding of a warning whose nature may be unchanging, over progressively wider intervals of time each day. This is in contrast to the mechanism proposed by Schwendinger, for instance, that produced progressively more intrusive warnings around-the-clock.

An advantage of the second embodiment is that, again, the muting interval is determined automatically by the mechanism itself, and consequently, that it requires no new user knowledge or training whatsoever, and does not require the user to program or configure the mechanism in any way. Hence, it requires no conscious effort whatsoever to use.

Third Embodiment

Muting Started at Time of Day when Switch is Manually Activated

A third embodiment is also shown in FIG. 1. TIMER AND CONTROL block 118 may be different from that of the first two embodiments to accommodate the following operational differences.

First, the momentary-contact switch or pushbutton 126 may used to specify the time of day of the start of the muting interval of the audio maintenance warning. A dedicated switch may be added for this purpose. Alternatively, the TEST/HUSH or TEST/SILENCE pushbutton may be reused. The pushbutton may be labeled, for example, "BEDTIME" for a dedicated switch, or "TEST/SILENCE/BEDTIME" for a multi-purpose switch.

Second, for this embodiment, the flexibility of LOOK UP TABLE 432 in FIG. 4 is not needed, so the flowchart shown in FIG. 2, rather than that of FIG. 4, may be used as an example of the operation. A single pair of hard-coded STARTBEEP and STOPBEEP values may be used to define a muting interval in block 234. In contrast with the first two embodiments, however, STOPBEEP and STARTBEEP will typically not be equidistant from the reference time of 0 hours. For example, STOPBEEP and STARTBEEP may be hard-coded to 0 hours and 12 hours, respectively. In this example, the audio maintenance warning will be muted for the 12-hour interval immediately following the time of day that the pushbutton was last pressed.

The following rule may then be used to determine the state of MUTE:

IF (TIME_OF_DAY<STARTBEEP) THEN MUTE=1;
ELSE MUTE=0;

Hence, the pushbutton switch will enable the user to specify the time of day at which the muting of the low-battery warning will be started, by simply pressing the pushbutton once at that time of day. This will reset the TIME_OF_DAY variable in the 24 HOUR TIMER 224, establishing a new reference time of day. Thereafter, TIMER AND CONTROL block 118 will mute the warning for a predetermined interval, starting approximately at the time of day that the pushbutton was pressed.

The starting time for the muting interval may be optionally offset from the time of day that the pushbutton was pressed by some amount of time, if desired, and other muting intervals may be optionally chosen. Alternately, instead of setting the starting time of the muting interval, the time of day for the start of the warning sounding interval may be set, in a like manner. Additionally, the power-on reset signal, generated when the battery is connected, may be elongated to effectively offset the default reference time of day from the battery installation time of day, if it is deemed advantageous to do so; such an elongated power-on reset signal may be terminated by the pressing of the BEDTIME pushbutton, if it is pressed.

Hence, the audible warning may be silenced for a preselected interval each day, starting approximately at the time of day that the BEDTIME pushbutton was last pressed.

This embodiment has the advantage that a user may explicitly define a bedtime and its associated muting interval with a single press of a pushbutton, and without the need for a digital display.

General Remarks Regarding the First Three Embodiments

Any of the forgoing embodiments may be implemented with a modest complement of hardware, including an inexpensive electronic oscillator of modest accuracy, a battery condition sensor, and digital logic or a simple microcontroller for implementing the 24-hour timer, control and interface functions. If a microcontroller and a continuously running oscillator with acceptable accuracy are already present in an existing hazard detector design, no hardware changes will be needed to incorporate an embodiment into the existing design; its functions may be implemented by simply expanding the software. Consequently, there may be no additional production cost whatsoever associated with the incorporation of the embodiments. This is essentially the case for several commercially available smoke and carbon monoxide detectors that presently use Microchip PIC 16LF18XX and PIC 16LF193X microcontrollers, such as certain First Alert® detectors made by BRK Brands, Inc. of Aurora, Ill., and certain Code One® detectors made by Kidde, of Mebane, N.C.

Although the 24-hour timer used by the mechanism in the first three embodiments functions similarly to a standard time clock, there is no need for the timer to know the standard clock time. The timer is simply reset by either the installation of the battery or by the press of a pushbutton. Consequently, in these embodiments, setting of the standard clock time, and numerical setting of the muting or warning-sounding time, is not required. Therefore, a numerical display of clock time is not necessary. This constitutes an advantage over a method or mechanism that uses a standard real-time clock in that the hazard detector can be smaller, simpler, and cheaper, can have lower power consumption and longer battery life, and will be easier to deploy.

Fourth Embodiment

Muting Started at Time Specified by User-Selected Delay

Figure 5:
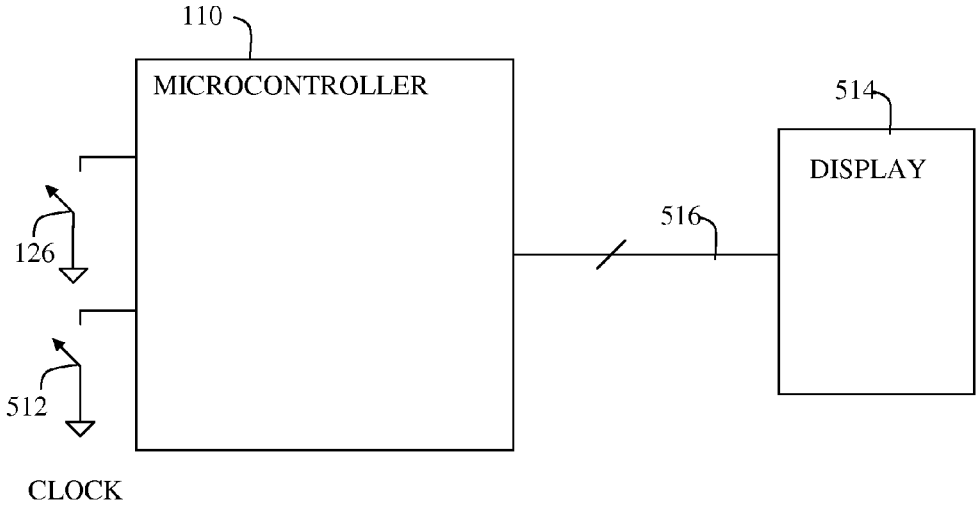
FIG. 5 is a block diagram of a version of an operator interface that includes a digital display and a second pushbutton switch.

A fourth embodiment, shown in the block diagrams of FIGS. 1 and 5, adds a numerical display 514 with at least two digits, seen in FIG. 5. The numerical display is used to display the number of hours until the start of the muting interval. The start of the muting interval may, for instance, correspond to the user's bedtime. This will implicitly allow the user to manually specify, at any time of day, the approximate time of day of the start of the muting interval. To do this, the user presses a pushbutton until the display shows the number of hours before bedtime; one of the existing pushbuttons may be re-used, or a dedicated HOURS UNTIL BEDTIME pushbutton may be added. Thereafter, as time progresses, the displayed number of hours may automatically count down until it registers 0, at which time the muting period of pre-defined duration begins. Alternatively, the starting time of day for the warning sounding interval may be set, in a like manner.

Display 514 has at least two digits to display HOURS UNTIL BEDTIME, with an approximate range of 0 to 23 hours, and is driven by the logic or microcontroller 110 using display signals 516. For the fourth embodiment only one switch 126 is needed; CLOCK switch 512 is not used.

The flowcharts of FIGS. 2 and 3 illustrate the operation of the fourth embodiment, as before, except that in FIG. 2, conditional block 216 is not used; the variables of process block 212 are initialized only once after POR, and are not re-initialized by the pressing of any pushbutton switch. In addition, STARTBEEP and STOPBEEP times are supplied from the user interface, and the MUTE signal is determined differently, as detailed below.

Figure 6:
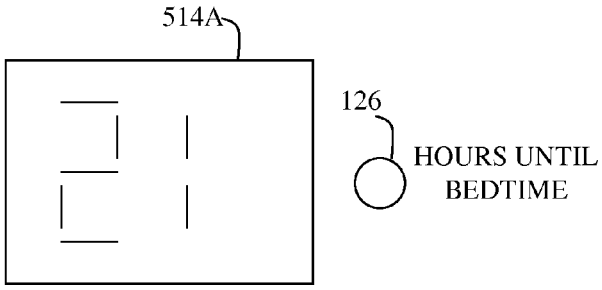
FIG. 6 is a pictorial drawing of an example of an operator interface that may be used to set a delay time, and that includes a digital display and a pushbutton switch.

FIG. 6 is a pictorial example of a user interface that can be used for the fourth embodiment. Display 514A is a version of display 514 that is tailored to show HOURS UNTIL BEDTIME, and pushbutton switch 126 is used to increment, or optionally decrement, the displayed HOURS UNTIL BEDTIME, in a conventional manner. Whenever pushbutton 126 is pressed, STOPBEEP and STARTBEEP, used in process block 234, may be immediately calculated as $$\text{STOPBEEP}=|\text{TIME_OF_DAY}+\text{HOURS_UNTIL_BEDTIME}|_{modulo\ 24}$$

$$\text{STARTBEEP}=|\text{STOPBEEP}+12|_{modulo\ 24}$$

where $|x|_{modulo\ 24}$ is equal to the remainder after the quantity x is divided by 24 hours, using integer division and compatible units of time; this definition is used throughout this document. Here numeral 12 represents an example of 12 hours of muting.

Because the timer is not reset when the delay is set by the user, STOPBEEP and STARTBEEP times may have a random offset from TIME_OF_DAY; this makes the rules for determining the state of the MUTE signal somewhat more complicated, as follows:

IF STARTBEEP<STOPBEEP, AND
IF (TIME_OF_DAY>=STARTBEEP) AND (TIME_OF_DAY<STOPBEEP) THEN MUTE=0;
ELSE IF STARTBEEP>STOPBEEP, AND
IF (TIME_OF_DAY>=STARTBEEP) OR (TIME_OF_DAY<STOPBEEP) THEN MUTE=0;
ELSE MUTE=1;

Thereafter, the display may be automatically updated by software or hardware with additional useful indications, as mentioned above, if desired. For example, the displayed HOURS UNTIL BEDTIME may be decremented as each hour of time passes, so that the displayed number of hours counts down as the time of day approaches bedtime. In another example, the display numerals can be blanked, and the BED display annunciator made to flash, during the muting interval, unless the pushbutton is pressed.

Compatible units of time must be used in the calculations and appropriate units of time must be used for display.

An advantage of the fourth embodiment is that it frees the user from having to press a pushbutton at bedtime, as was required for the third embodiment; rather, the user may configure the muting at any time of day.

Fifth Embodiment

Muting Started at Time Explicitly Specified by User

A fifth embodiment, shown in the block diagrams of FIGS. 1 and 5, again uses numerical display 514 with at least two digits, and, optionally, a second switch 512, both shown in FIG. 5. This is similar to the fourth embodiment except that display 514 is used to display at least the clock time in a conventional two-digit 24-hour or 12-hour AM/PM clock time format. The display has two modes: a standard CLOCK time display mode, and a time of start of muting interval, or BEDTIME, display mode. The two display modes are similar to the CLOCK and ALARM display modes of a standard alarm clock. In the CLOCK display mode the two digits represent the hour digits of standard clock time, which will typically increment each hour, or reset after each 24-hour period, as time progresses. In the BEDTIME display mode, the two digits represent the approximate start time of the muting interval, which will be unchanging after being set. For this embodiment, the user manually sets both the CLOCK time and the BEDTIME. This allows the user to manually specify, at any time of day, the approximate time of day of the start of the muting interval.

To set times, the user may press a CLOCK pushbutton 512 until display 514 shows the correct standard CLOCK time, and press a BEDTIME pushbutton 126 until display 514 shows the desired BEDTIME, all in a conventional manner. Alternately, if only one pushbutton is used, the user may toggle the setting and display mode between CLOCK time and BEDTIME by pressing and holding the one pushbutton, all in a conventional manner. Existing pushbuttons may be re-used, or two dedicated CLOCK and BEDTIME pushbuttons may be added, or a single CLOCK/BEDTIME pushbutton may be added.

Thereafter, the low-battery warning will be silenced during the muting period of pre-defined duration.

Alternatively, the time of day for the start of the warning sounding interval may be set, in a like manner; in this case, the label "BEDTIME" on switch 126 can be changed to "WARNING TIME", for example.

Figure 7:
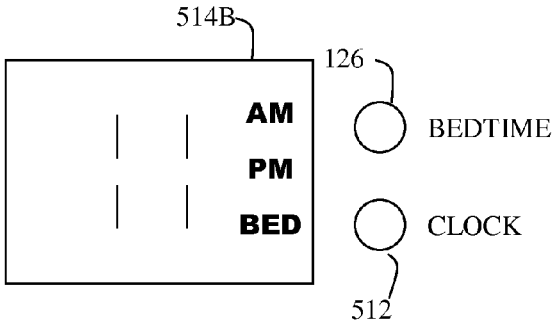
FIG. 7 is a pictorial drawing of an example of an operator interface that may be used to set clock times, and that includes a digital display and two pushbutton switches.

FIG. 7 is a pictorial example of a user interface that can be used for the fifth embodiment. Display 514B is a version of display 514 that is tailored to display CLOCK time and BEDTIME, in a 12-hour format, for example. Switch 512 may be used to increment, or optionally decrement, the displayed CLOCK time, in a conventional manner. Switch 126 may be used to increment, or optionally decrement, the displayed BEDTIME, in a conventional manner. When switch 126 is pressed, STOPBEEP and STARTBEEP may be immediately calculated from the resultant new BEDTIME as $$STOPBEEP=|BEDTIME|_{24\ hour\ format}$$
$$STARTBEEP=|STOPBEEP+12|_{modulo\ 24}$$

Again the number 12 represents an example of 12 hours of muting per day. $|BEDTIME|_{24\ hour\ format}$ means that BEDTIME is expressed in a standard 24-hour format, rather than a 12-hour format.

Thereafter, until and unless the pushbuttons are pressed, the value of BEDTIME will not change. The displayed value of CLOCK time may be updated as 24 HOUR TIMER 224 increments time, in a conventional manner. The values of CLOCK time and BEDTIME may be selected for display, and modified, in any conventional manner, using one or two pushbuttons, and using conventional software or hardware. Conventional hardware or software may be used to implement the operation of the display 514 and the associated pushbutton switches 126 and 512.

The fifth embodiment may use the flowcharts of FIGS. 2 and 3, similarly to the first embodiment, for example, except that STARTBEEP and STOPBEEP times will be supplied from the user interface, as detailed above. The state of MUTE may be determined in the same manner as for the fourth embodiment.

The fifth embodiment has at least two advantages. First, it frees the user from having to press the BEDTIME pushbutton at bedtime, as for the third embodiment; rather, the user may configure the muting at any time of day. Second, it has a familiar user interface that certain users may prefer.

CONCLUSION, RAMIFICATIONS, AND SCOPE

As explained, the embodiments described above will make hazard detectors initially emit their routine warnings at times of day when it is likely that residents will be awake, rather than when they are sleeping, in a manner that provides a safer and more user-friendly warning. When implemented, the embodiments will not only help to preserve the sleep of tens of millions of residents, but will also help to eliminate the dangerous disabling of tens of millions of hazard detectors that might otherwise occur each year. This will result in fewer fires, or less disastrous fires, and fewer injuries and lives lost.

The initial warnings may be sounded in a number of different ways, depending on the implementation:

- proximate to the time of day that the battery was installed or replaced, for the implementation shown in FIGS. 1, 2, and 3;
- proximate to the time of day that the hazard detector was last tested or temporarily muted, also for the implementation shown in FIGS. 1, 2, and 3, but with certain modifications, as discussed;
- at times of day except those within a muting interval, with the muting interval starting proximate to the time of day that a pushbutton was last pressed, also for the implementation shown in FIGS. 1, 2, and 3, but with certain other modifications, as discussed;

at times of day except those within a muting interval, the time of day of the start of the muting interval being defined when the user programs a delay to the start of the interval, for the implementation shown in FIGS. 1, 2, 3, 5 and 6; and at times of day except those within a muting interval, the time of day of the start of the muting interval being explicitly selected by the user, for the implementation shown in FIGS. 1, 2, 3, 5 and 7.

The first two options have the advantage that they operate in a completely automatic manner, requiring no user configuration or programming whatsoever. Hence, they require no conscious effort whatsoever to use. The first two options, in particular, may benefit from an automatically expanding warning interval, as may be implemented by replacing the flow chart of FIG. 2 with that of FIG. 4. The third option has the advantage that a user may explicitly define a bedtime, with a single press of a pushbutton, and without the need for a digital display. The fourth option has the advantage that a user may, at any time of day, implicitly define a bedtime by setting a delay time. The fifth option has the advantage that, at any time of day, a user may explicitly define a bedtime by using a familiar user interface.

The oscillator included in the embodiments may typically be a crystal oscillator or a ceramic resonator oscillator. In this application, a time-of-day error of, say, 10 minutes after an elapsed time of one year would be quite acceptable; this corresponds to an oscillator frequency error of 20 ppm, a specification that may be easily met with inexpensive, commonplace components.

For the first three embodiments in particular, most or all of the necessary hardware is already present in many commercially available smoke detectors and carbon monoxide detectors. In these cases, it is possible that no hardware changes whatsoever will be needed to incorporate an embodiment into an existing hazard detector design; the embodiment's functions may be implemented by simply expanding the software. Consequently, there may be no additional production cost whatsoever associated with the incorporation of the embodiments.

In other commercially available hazard detectors, all of the hardware for even the fourth and fifth embodiments, including the two-digit display, is already present. In these cases, incorporation of the embodiments may only entail some labeling and software changes, and, consequently, there again may be no additional production cost whatsoever associated with the incorporation of the embodiments.

Even if none of the requisite hardware is available in an existing design, it is possible to implement the basic functions of the first three embodiments by adding a small 6-pin or 8-pin microcontroller or Real Time Clock (RTC) integrated circuit, a 32 KHz crystal, and two loading capacitors, all of which will consume less than 0.1 $in^2$ of PCB area, and whose cost impact will be very modest, if not insignificant.

Regarding battery life, microcontrollers with an onboard CMOS 32 KHz oscillator draw on the order of 1.0 μA to 10.0 μA; RTC integrated circuits draw as little as 0.5 μA. The currents at the low ends of these ranges are small compared even to the tiny 6.0 μA that a typical dedicated-function, low-cost smoke detector integrated circuit draws. Such smoke detector integrated circuits are typically powered by an inexpensive 9V battery rated at a capacity of about 300.0 mAh at a discharge current of 5.0 mA. At a much lower discharge rate, as would be expected for a device like a smoke detector, the battery will exhibit a significantly greater mAh rating. However, even if one assumes the lower battery capacity associated with a 5.0 mA discharge current, and if desired battery life is one year, the allowable average discharge current would be calculated to be as much as 34.0 uA. Hence, the current draw of an embodiment is likely to have only a minor impact on battery life when added to a standard low-cost smoke detector design. Further, hazard detectors that already incorporate microcontrollers commonly use a pair of 1.5V AA batteries, with a rated capacity of about 2000.0 mAh at a discharge current of 10.0 mA. This capacity will even more easily accommodate an embodiment's current draw. In fact, if a suitable microcontroller is already present in a design, the impact on battery life of incorporating an embodiment is likely to be negligible.

Although prior-art devices include 24-hour timers designed for connecting and disconnecting AC power to lamps and household appliances, and which have a button for programming the appliance on and off times, the embodiments disclosed here are different for at least several reasons. All of the embodiments constitute a new use of a 24-hour timer, in that the timer is not being used as a general-purpose, stand-alone device for connecting and disconnecting AC mains power to plug-in appliances or lamps, as in prior art. Rather, it is used as a dedicated mechanism incorporated into a hazard detector for the purpose of generating a low-voltage, low-power control signal that may be used to mute an warning.

In addition, the first two embodiments may automatically set the reference time of day to the time of day of battery installation, without any requirement for the user to press a pushbutton, and by that very aspect operate in a manner that is novel, and completely contrary to that of the timers of prior art. The third embodiment, and the mode of the first two embodiments in which the reference time is set to the time of day of the last pressing of a pushbutton, is additionally different from the prior art in that prior art appliance timers require at least two pushbutton presses in order to program a sequence, else, the controlled appliance would be either on indefinitely, or off indefinitely.

In contrast, the first three embodiments can be made to work with as little as a single press of the pushbutton to set the time-of-day reference time, which may then be used to allow the muting of a warning for a predetermined duration. The user interface in the fourth embodiment is additionally different from prior art in that the number of hours before the start of the muting interval, versus the clock time of the start of the muting interval, is being set and counted down. The user interface of the fifth embodiment, comprising the display and pushbutton(s), constitutes a new use of a prior art user interface, employed here to explicitly specify the starting time of day of the muting interval.

Although the description above contains many specificities, these should not be construed as limiting the scope of the embodiments but as merely providing illustrations of some of several embodiments. Many variations are possible within its scope.

For example, the flow charts of FIGS. 2, 3, and 4 are used to illustrate an example of how the mechanism may be implemented; however, a skilled practitioner will recognize that other flow charts, representing equivalent mechanism functions, may be used to implement the mechanism.

A skilled practitioner will recognize that the logic function represented by PRESCALE 116 and TIMER AND CONTROL 118 in FIG. 1, and the flow charts of FIGS. 2, 3, and 4 may be implemented either in digital logic hardware, or as software running on microcontroller hardware, or using a dedicated-function integrated circuit such as a Real Time Clock (RTC), or as any combination thereof. BATTERY CONDITION SENSOR 120 and RESET 122 in FIG. 1 may be part of a microcontroller, or may be implemented in separate circuitry.

The battery condition sensor may optionally employ deliberate loading of the battery while it measures the battery voltage.

For the first three embodiments, oscillator 114, prescaler 116, and 24 HOUR TIMER 224 need not produce a time variable with units of seconds, minutes, hours, or any other familiar unit of time. TIMER 224 may use any time unit of adequate resolution, as long as TIMER 224 is cyclically reset at an interval sufficiently close to 24 hours that time of day is preserved with the desired accuracy, and as long as the STARTBEEP and STOPBEEP times are properly set in whatever units are chosen. For the fourth and fifth embodiments, however, it may be more convenient to use a timer that includes output units of hours, for example, so that the user interface will display units that are familiar to users.

Further, although the example of the timer period of operation referred to here was 24 hours, other periods of operation, of say a week, a month, or a year, or some other interval, may be advantageous in other applications. In addition, although the example of inhibitory duration described here was less than 24 hours, other inhibitory durations may be advantageous in other applications.

For the third, fourth and fifth embodiments, controls that are local to the hazard detector for setting the start of the muting or sounding interval have been described. However, the same functions could be implemented a remote control transmitter, if corresponding receivers were incorporated into the hazard detector, all in a conventional manner.

As mentioned, for all of the described embodiments, an alternative implementation may be used to define and detect two battery conditions, i.e., ALBC and LBC. For the two-battery-condition implementation, the embodiments will transition to allowing around-the-clock warnings when LBC goes active, rather than when the DAYS variable, maintained by DAY COUNTER 230, reaches value N, as was described in detail above for the single-battery-condition implementation. Either means may be used with equivalent results, and a skilled practitioner will be able to implement the double-battery-condition implementation, in a like manner to that of the single-battery-condition implementation.

The initial low-battery warning issued in the first and second embodiments may optionally be held off for a day, to allow the warning to first be issued a full hour before the reference time if, for example, the ALBC first happens to occur during the interval defined for sounding the warning.

Switch 126 may optionally be omitted in the first and second embodiments, so that the reference time of day is set solely to the time of day that the battery was installed. This reduces the amount of hardware needed for implementation of the embodiments.

Although the system provides an improvement for existing smoke and carbon monoxide detectors, it may be used to enhance the operation of any device or instrument that issues aural, visual, or tactile signals that can benefit from inhibiting at certain times when these signals would be undesirable.

Although the maintenance procedure that has been most often referred to here is that of replacing a battery, warnings for any other maintenance procedure, such as sensor end-of-life replacement, for instance, may be muted by an embodiment. Muting may be advantageously applied even to warnings from hazard detectors powered by the commercial AC power mains. If the warning to be muted is not a low-battery warning, the mechanism will function in a similar manner to that already described, with some exceptions: BATTERY CONDITION SENSOR 120 in FIG. 1 may not be needed; conditional block 228 in FIGS. 2 and 4, rather than testing for ALBC, may instead test for the warning condition of interest; and if the UL 217 requirement for seven days of around-the-clock warnings does not apply, and indefinite partially-muted warnings are desired, subroutine blocks DAY COUNTER 230 and LOOK UP TABLE 432 in FIG. 2 may not be needed. In addition, if the maintenance procedure does not involve removal of the battery, and DAY COUNTER 230 is used, an alternate means for resetting DAY COUNTER may be provided, in a conventional manner.

The switches have been described as momentary-contact electromechanical pushbutton switches, but any other type of switch or sensor that is suitable for user manipulation of the mechanism may be used.

In any of the embodiments, lights or audible signals may be used for user interface feedback when pressing pushbuttons, in a conventional manner.

Thus, the scope of the embodiments should be determined by the appended claims and their legal equivalents, rather than by the examples given.

I claim:

1. An electronic mechanism for use within a device powered by a battery and that provides a warning upon a predetermined condition, comprising:

a. a timer that provides time of day, b. a condition sensor that detects said predetermined condition, c. setting means for receiving a range of time, d. comparison and inhibiting means for comparing said time of day provided by said timer and said range of time for inhibiting said warning when said time of day is within said range of time, and e. a power-on-reset circuit resetting said timer when said battery is installed thereby establishing a reference time, and wherein said range of time setting is predetermined in such a way that the issuance interval of said warning is approximately centered about said reference time, whereby said mechanism issues said warning at a time of day proximate to that time of day when said battery was installed and is automatic and requires no user programming, whereby the issuance of said warning will be inhibited by said comparison means during said range of time, and said issuance of said warning will occur only outside said range of time.

2. The mechanism of claim 1 wherein said setting means is able to be set to a plurality of said range of time settings, and further including a day counter, and a selection means for sequentially selecting members of said plurality of said range of time settings as days pass, said selection means being arranged to sequentially select a new member of said plurality of said range of time settings for each day, whereby said issuance interval of said warnings is proximate to said reference time, but whose duration is gradually increased, day by day, and said mechanism is automatic and requires no user programming.

3. An electronic mechanism for use within an electrically powered device that provides a warning upon a predetermined condition, comprising:

a. a warning circuit for issuing a warning upon the occurrence of said predetermined condition within said device, b. a timer for providing the time of day, c. a memory for providing a range of time when said warning is to be inhibited, d. a circuit for comparing said time of day with said range of time and for providing an inhibiting signal when said time of day is within said range of time, e. said warning circuit being responsive to said inhibiting signal for inhibiting said warning in response to said inhibiting signal, f. a power-on-reset circuit so that said timer may be reset when said battery is installed thereby establishing a reference time, and wherein said range of time setting is predetermined so that the issuance interval of said warning is approximately centered about said reference time, whereby said mechanism issues said warning at a time of day proximate to that time of day when said battery was installed and is automatic and requires no user programming, whereby said warning will be inhibited during said range of time.

4. The mechanism of claim 3, further including a day counter, a plurality of said range of time settings, and a selector for sequentially selecting members of said plurality of said range of time settings as days pass, said selector being arranged to sequentially select a new member of said plurality of said range of time settings for each day, whereby said issuance interval of said warnings is proximate to said reference time, but whose duration is gradually increased, day by day, and said mechanism is automatic and requires no user programming.

5. A method for inhibiting a warning issued upon a predetermined condition by a device powered by a battery comprising:

a. providing a time of day within said device, b. detecting said predetermined condition within said device, c. setting a range of time within said device, and d. comparing, within said device, said time of day and said range of time and inhibiting said warning when said time of day is within said range of time, whereby said warning will be inhibited during said range of time, and said warning will be issued by said device only outside said range of time, and resetting said timer when said battery is installed, thereby establishing a reference time, and wherein said range of time setting is predetermined in such a way that the issuance interval of said warning is approximately centered about said reference time, and whereby said method causes said warning to be issued at a time of day proximate to that time of day when said battery was installed, and is automatic and requires no user programming.

6. The method of claim 5, further comprising counting the days that pass after said detection of said predetermined condition, defining a plurality of said range of time settings with increasing durations, and sequentially selecting members of said plurality of said range of time settings as said days pass, whereby said issuance interval of said warnings is proximate to said reference time, but whose duration is gradually increased, day by day, and said method is automatic and requires no user programming.

* * * * *